US006688316B1

(12) United States Patent
Klug

(10) Patent No.: US 6,688,316 B1
(45) Date of Patent: Feb. 10, 2004

(54) DECORATIVE HAIR ACCESSORY KIT WITH INTERCHANGEABLE DECORATIONS AND STORAGE BOARD

(76) Inventor: Claudia Klug, 39 Essex St., Barre, VT (US) 05641

( * ) Notice: Subject to any disclaimer, the term of this patent is extended or adjusted under 35 U.S.C. 154(b) by 0 days.

(21) Appl. No.: 10/262,835

(22) Filed: Oct. 3, 2002

(51) Int. Cl.[7] ..... A45D 40/00; A45D 8/12; B42F 17/00

(52) U.S. Cl. ..... 132/286; 132/275; 211/13

(58) Field of Search ..... 132/286, 273, 132/275, 277, 276, 278, 279; 211/13, 87

(56) References Cited

U.S. PATENT DOCUMENTS

| | | | | |
|---|---|---|---|---|
| 5,427,123 A | | 6/1995 | Odenthal | 132/275 |
| 5,671,849 A | * | 9/1997 | Bacon | 211/13 |
| 5,706,836 A | | 1/1998 | McKeown | 132/275 |
| 6,082,371 A | | 7/2000 | Bader-Saltzman et al. | 132/276 |
| 6,131,585 A | | 10/2000 | Reinstein et al. | 132/275 |
| 6,142,158 A | | 11/2000 | Lloyd et al. | 132/275 |
| 6,237,611 B1 | | 5/2001 | LeCrone et al. | 132/275 |
| 6,289,903 B1 | | 9/2001 | Haufler | 132/275 |
| 2002/0066462 A1 | | 6/2002 | Denebeim | 132/275 |

FOREIGN PATENT DOCUMENTS

| | | | |
|---|---|---|---|
| GB | 2301031 A | 11/1996 | A41G/5/00 |

* cited by examiner

*Primary Examiner*—John J. Wilson
*Assistant Examiner*—Robyn Kieu Doan
(74) *Attorney, Agent, or Firm*—Richard C. Litman

(57) ABSTRACT

The decorative hair accessory kit with interchangeable decorations and storage board includes a hair band, hair comb, barrette and a plurality of interchangeable decorations, including a storage board for the components. Hook and loop fastening material adhesively attached to both the display surface of the hair controlling device and to the underneath surface of the decoration provide the attachment method by which decorations are interchangeably attached to the hair band, barrette, and hair comb. A decorative storage board provides a surface for storing the decorative hair accessories when not in use.

10 Claims, 4 Drawing Sheets

DECORATIVE HAIR ACCESSORY KIT WITH INTERCHANGEABLE DECORATIONS AND STORAGE BOARD

BACKGROUND OF THE INVENTION

1. Field of the Invention

The present invention relates to decorative hair accessories for securing a person's hair in place with different decorative effects and, more particularly, to headbands, barrettes, and hair combs, with attachable and interchangeable decorations or ornaments, providing a decorative fashion accessory for the hair.

2. Description of the Related Art

Despite the fact that the basic design of headbands, barrettes, and hair combs has remained unchanged, the ongoing demands of constantly changing fashion trends require a costly accumulation of hair controlling devices basically identical in structure, but different solely in the decorations or ornaments adorning the devices. The prior art reflects the desire to adapt to fashion trends, while minimizing the number of hair controlling devices by means of hair controlling devices with interchangeable decorations.

U.S. Pat. No. 6,237,611 B1, issued to LeCrone et al. in 2001, discloses a banded clothing device with pockets to receive ornaments. Such ornamentation may be in the form of clips, barrettes, hair pins or bobby pins having ornamentation such as bows, ribbons, flowers and the like.

U.S. Pat. No. 5,427,123, issued to Odenthal in 1995, discloses a headband kit with removable panels, interchangeably attachable to the display surface by means of a friction fit within mounting holes.

Another interchangeable barrette assembly with ornamental components is seen in U.S. Pat. No. 6,142,158, issued to Lloyd et al. in 2000, which discloses an interchangeable barrette assembly, comprising an ornamental component with posts that snap into the body of the removable clasp assembly.

U.S. Pat. No. 6,289,903 B1, issued to Haufler in 2001, describes a hair band consisting of a wearable body and a cord adapted to be woven through at least a portion of the body, the cord securing the ornaments to the body.

Hook-and-loop fastening systems (Velcro®) are in widespread use on numerous consumer products, including fashion accessories. U.S. Pat. No. 5,706,836, issued to McKeown in 1998, discloses al variety of hair ornamental and hair control devices utilizing a Velcro® system of hook-and-loop fasteners to comfortably and securely attach the ornament to the head. However McKeown utilizes hook-and-loop fasteners to secure the hair controlling device to the hair rather than to the hair controlling device.

U.S. Pat. No. 6,131,585, issued to Reinstein et al. in October 2000, discloses a hair ornament attachment system having decorative ornaments with hook fastening material on its reverser side for directly affixing the ornament to the hair and not the surface of a hair controlling device. Additionally, Reinstein et al. disclose a display unit consisting of loop fastening material for storing the ornaments when not in use.

U.S. Pat. No. 6,082,371, issued in July 2000, to Bader-Saltzman et al., discloses a novel hair clip utilizing hook-and-loop fastening for attaching hair decorations to the barrel of the hair clip. Additionally, U.S. patent application Ser. No. 2002/0066462 A1, published in June 2002, applied for by Denebeim, discloses a headband consisting of a strip of hook type fastening material on one side and loop type fastening material on its reverse side, said strip capable of attaching its ends to itself around ones head, and capable of having attached to it, a variety of ornaments and or hair attachments.

Hair related inventions utilizing hook-and-loop fastening material have been cited in foreign patents. For example, United Kingdom Pat. No. GB2301031A, issued to Graham and published in 1996, discloses a hairpiece comprising a headband and an hairpiece held to each other by hook-and-loop fastenings. Various interchangeable headbands are disclosed along with auxiliary combs or clips to aid fastening the hairpiece to the user's own hair. Although a hairpiece may be considered a decoration, the purpose of Graham's invention was not to provide interchangeable ornaments, but to provide an interchangeable means of best attaching a hairpiece to the user's head.

None of the above inventions and patents, taken either singularly or in combination, is seen to describe the instant invention as claimed. Thus a hair ornament kit with interchangeable decorations and a storage board solving the aforementioned problems is desired.

SUMMARY OF THE INVENTION

The invention relates to a decorative hair accessory kit. The kit includes a headband, a hair comb, a barrette, a plurality of interchangeable ornaments that are removable fixable to the hair controlling devices, and a panel for storing the components of the kit when not in use. The hair band is generally a resilient base in the shape of an open loop configured to the top of the head and straddling the head, and each end of the loop presses against the sides of the head.

The barrette is generally a elongated flat surface with a clip affixed to the underside of the flat surface for holding an amount of hair in a specific position on a wearer's head. The hair comb generally has teeth extending from a spine to secure the hair in a desired position.

All three of the hair controlling devices have an outer surface to which the decorative ornaments are removable attached by of hook-and-loop fastening material. The ornaments have an decorative surface and a back surface to which the hook portion of a hook-and-loop fastener is adhered, thus allowing the ornament to be fastened to the hair controlling device and easily interchanged with other ornaments to provide different fashion appearances.

Accordingly, it is a principal object of the invention to provide hair controlling devices with easily interchangeable and attachable ornaments.

It is another object of the invention to provide for storing the hair controlling devices and ornaments when not in use.

Furthermore, is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a hair accessory kit with interchangeable ornaments and a storage board designated generally as 4 and illustrated in FIGS. 1, 2A, 2B and 3.

Figure 1:
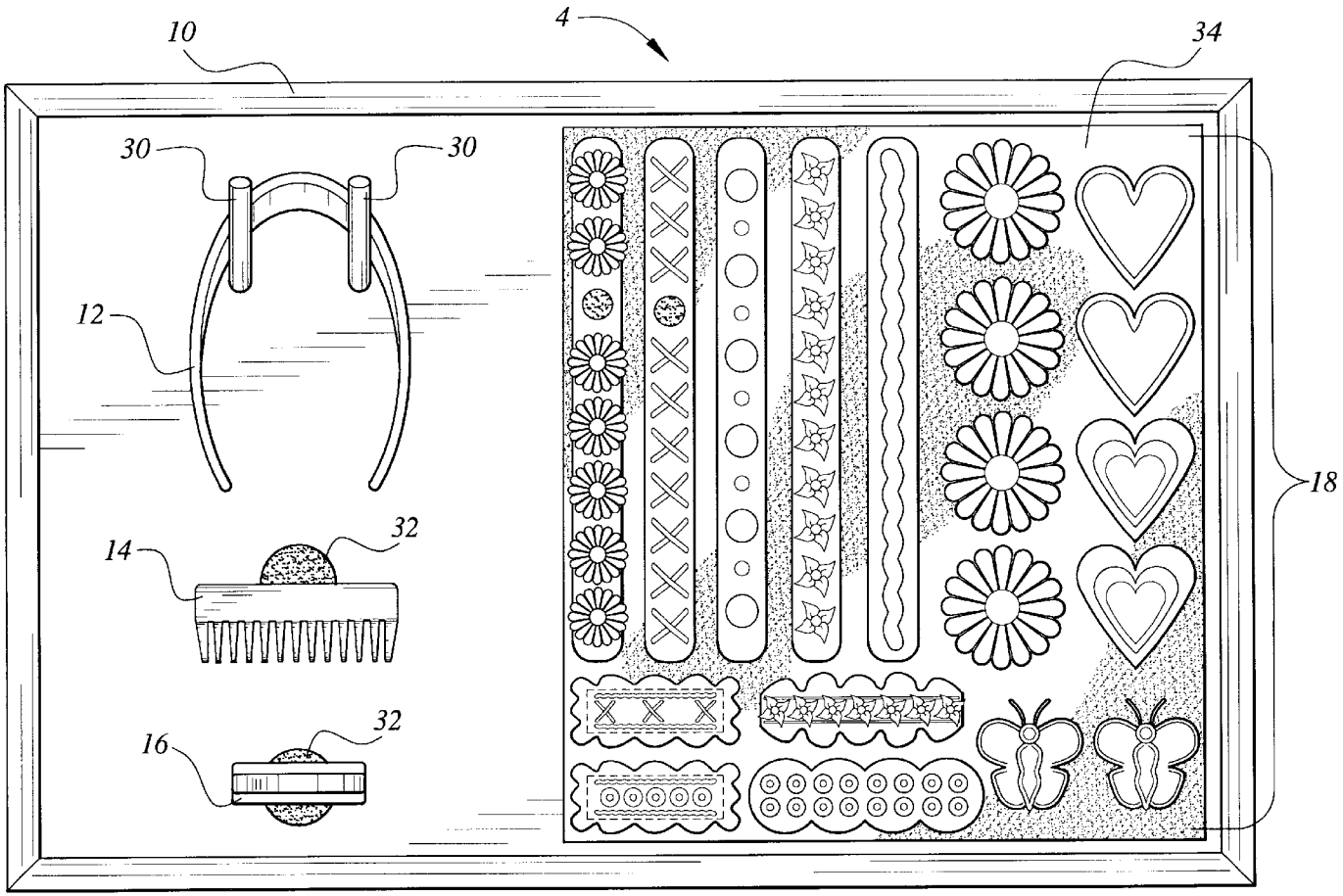
FIG. 1 is an environmental, frontal view of hair ornament system according to the present invention including the storage board, hair band, hair comb, barrette, and ornaments.

As best seen in FIG. 1, the preferred embodiment of the hair accessory kit 4 is made up of three hair controlling devices, namely a hair band 12, a hair comb 14, and a barrette 16; a plurality of interchangeable decorations 18 that are removable fixable to the hair controlling devices, and a storage board 10 for storing the kit components when not in use.

Figure 2A:
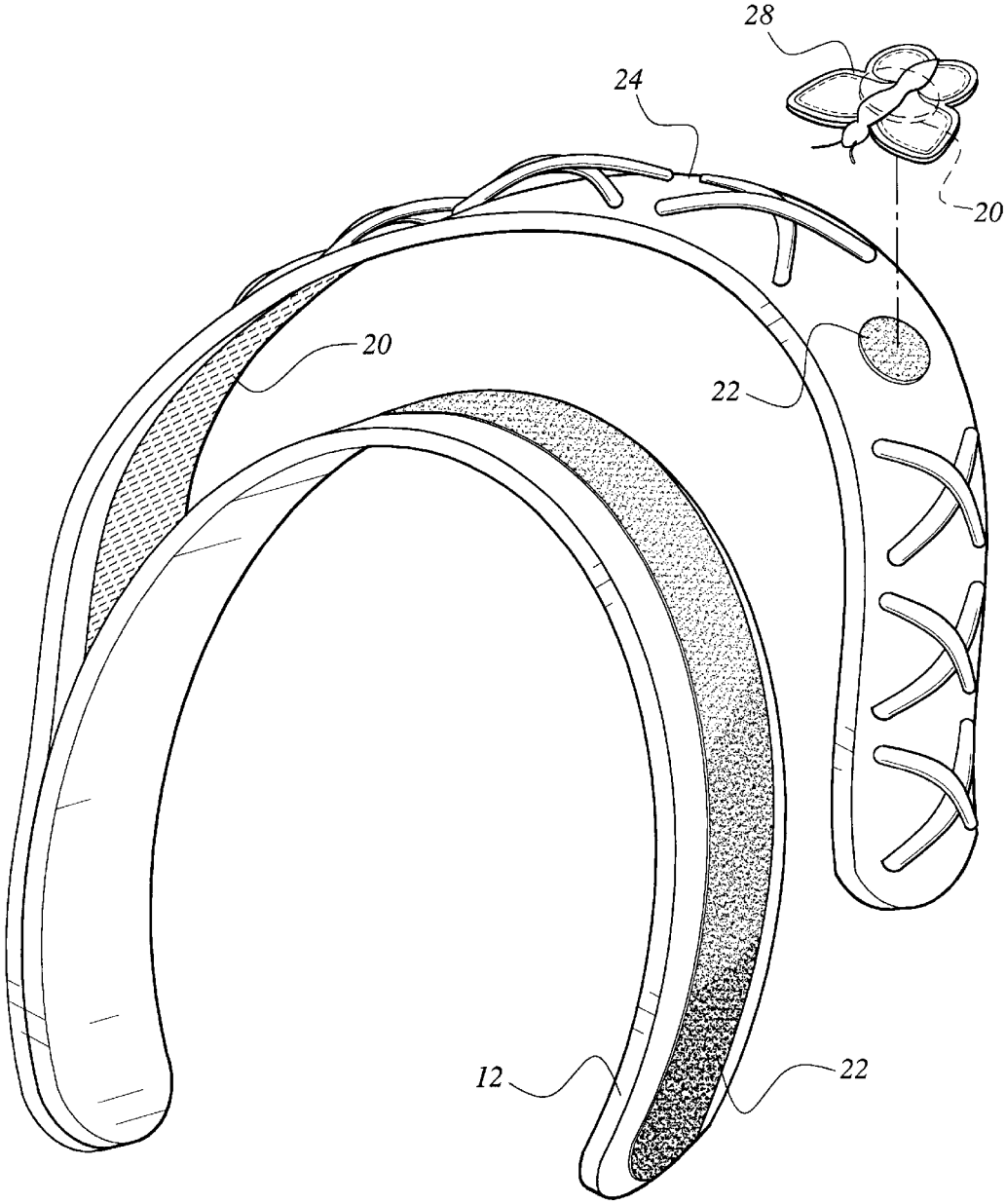
FIGS. 2A and 2B are perspective views of the hair band, barrette and hair comb with their attachable decorations.
Figure 2B:
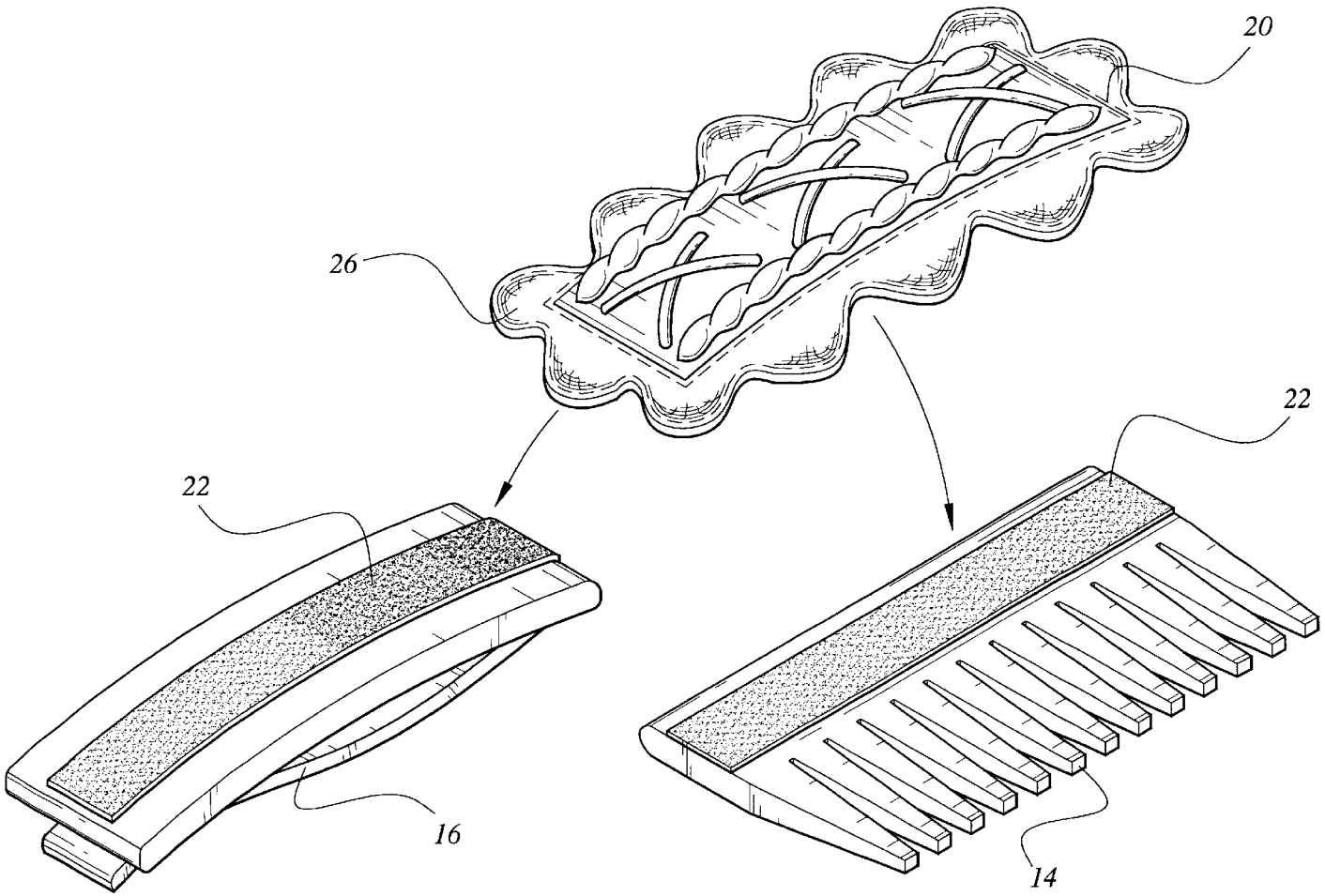

As shown in FIGS. 2A and 2B, the ornaments 18 which decorate the hair controlling devices 12, 14 and 16, are removable attachable to the hair band, hair comb and barrette, respectively, using hook-and-loop fasteners. A narrow strip of the hook portion of material 20 is adhesively attached to the inner surface of the ornament 24, 26 and mates to a strip of matching loop material 22 adhesively attached to the outer surface of the hair band 12, comb 14 and barrette 16.

Several embodiments of the ornament are disclosed. FIG. 2A shows an ornament 24 extending the full length of the hair band 12. FIG. 2B illustrates the barrette 14 and hair comb 16 having loop-fastener material 22 of the same length in order to support interchangeably the same decoration 26. A further embodiment of the ornament depicts a smaller ornament 28 (FIG. 2A) removable attached to a larger ornament 24 using hook-and-loop fastener material. Thus, it is appreciated that the hair band, comb, and/or barrette may be provided with one or more of a plurality of decorations for alternative fashion statements.

As illustrated in FIG. 1, all kit components are designed to be stored on a storage board 10 when not in use. Conveniently, board 10 may be suspended vertically on a wall, although this is not mandatory. The hair band 12 is supported by two posts 301 extending perpendicularly outwardly from the surface of the storage board 10.

Circular pads of loop material 32 adhesively attached to the storage board 10 provide an attachment for the hair comb 14 and barrette 16 when not in use. A sheet of loop fastener material 34 is adhesively affixed to the storage board 10 and serves as the mounting surface for the ornaments 18 when they are not in use.

Figure 3:
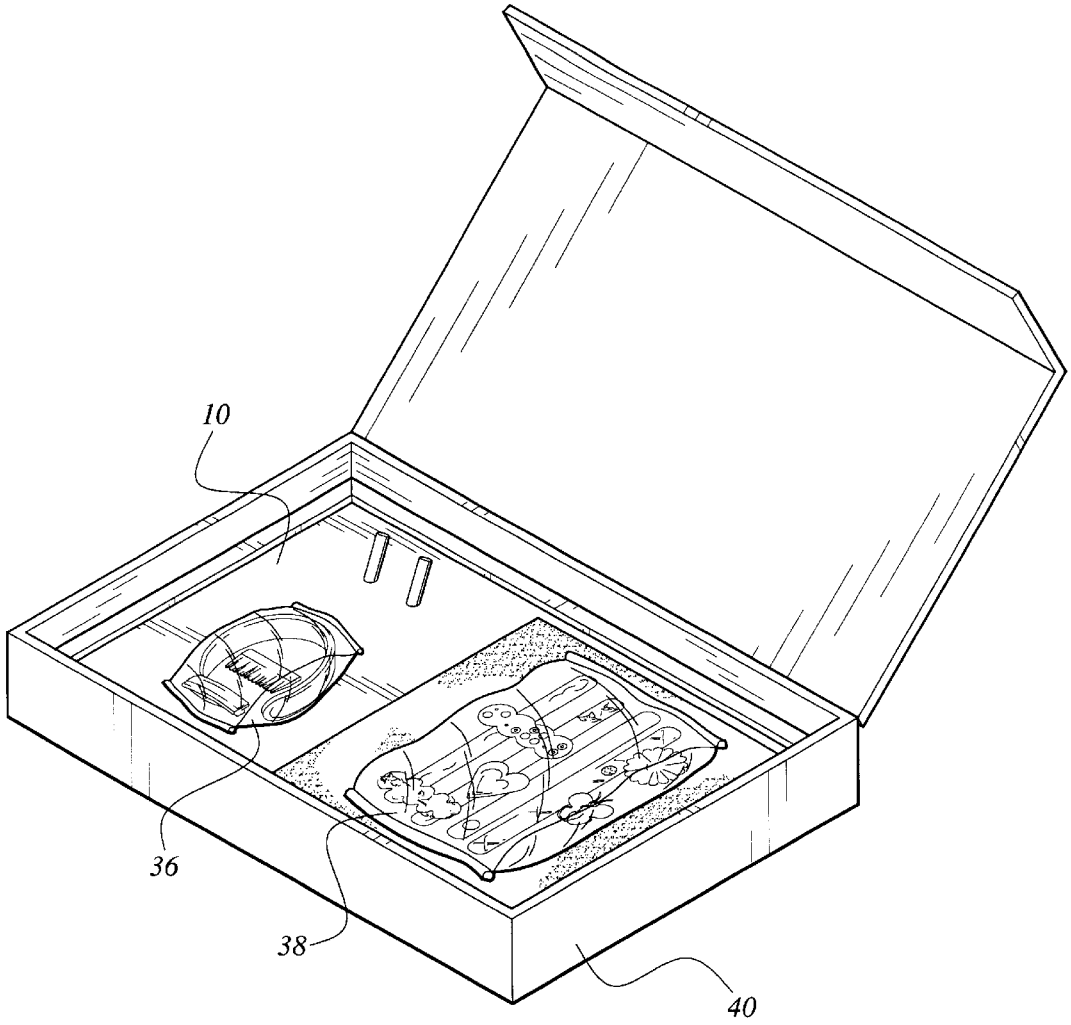
FIG. 3 is a packaged hair ornament kit according to the invention.

Referring now to FIG. 3, the decorative hair accessory kit can come in a packaged kit form. A hair band, a barrette, and a hair comb are placed in a plastic package 36, while a plurality of interchangeable barrette and hair comb ornaments, hair band ornaments, and smaller ornaments are placed in a separate plastic package 38. Both plastic packages and the storage board 10 are combined in a decorative box 40.

It is to be understood that the present invention is not limited to the embodiments described above, but encompasses any and all embodiments within the scope of the following claims.

I claim:

1. A decorative hair accessory kit comprising:

(a) a hair band of resilient material, formed in an open loop to conform to the head of a wearer when fitted over the top of the head, the band having a flat outer surface;

(b) a barrette having an elongated flat top surface and a clip affixed to the underside of said barrette for holding an amount of hair in a specific position on a wearer's head;

(c) a hair comb having an elongated flat spine and a series of teeth extending therefrom along one side of said spine;

(d) a plurality of decorative ornaments, each of said plurality of ornaments having a decorative side, an underside, and adapted to the shape of said hair band, said barrette or said hair comb either singularly or in tandem with others of said ornaments;

(e) a storage board providing detachable attachment of said hair band, said barrette, said hair comb, and said ornaments;

(f) a piece of hook-and-loop material affixed to the underside of said ornaments and adapted to engage the hook and loop material of said hair band, said barrette and said hair comb; and (g) a small piece of hook-and-loop material affixed to the decorative side of said ornaments.

2. The decorative hair accessory kit according to claim 1, further comprising a piece of releasable hook-and-loop material adhesively affixed to the said flat outer surface of said hair band, the length of said hook-and-loop material conforming to the length of the said hair band.

3. The decorative hair accessory kit according to claim 1, further comprising a piece of releasable hook-and-loop material adhesively affixed to the said elongated flat top surface of said barrette.

4. The decorative hair accessory kit according to claim 1, further comprising a piece of releasable hook-and-loop material adhesively affixed to the said elongated flat spine of said hair comb.

5. The decorative hair accessory kit according to claim 1, wherein said storage board is provided with a decorative, trimmed perimeter.

6. The decorative hair accessory kit according to claim 1, further comprising a lidded storage box for said kit.

7. A decorative hair accessory kit comprising:

(a) a hair band of resilient material, formed in an open loop to conform to the head of a wearer when fitted over the top of the head, the band having a flat outer surface;

(b) a barrette having an elongated flat top surface and a clip affixed to the underside of said barrette for holding an amount of hair in a specific position on a wearer's head;

(c) a hair comb having an elongated flat spine and a series of teeth extending therefrom along one side of said spine;

(d) a plurality of decorative ornaments adapted to the shape of the said hair band, said barrette or said hair comb either singularly or in tandem with others of said ornaments; and (e) a storage board providing detachable attachment of said hair band, said barrette, said hair comb, and said ornaments, wherein said storage board includes:

(a) a four sided flame unit having a perimeter (formed by decorative trimming);

(b) an ornament mounting surface comprising a sheet of loop portion of hook-and-loop fastener material adhesively affixed to said storage board;

(c) a support for said hair band comprising a pair of posts extending from the surface of said storage board, the distance between the posts adapted to support said hair band;

(d) a support for said barrette comprising a piece of hook-and-loop material adhesively affixed to said storage board; and (e) a support for said hair comb comprising a piece of hook-and-loop material adhesively affixed to said storage board.

8. The decorative hair accessory kit according to claim 7, wherein said storage board is provided with an attachment means on the rear of the said storage board, for affixing the storage board to a vertical surface.

9. The decorative hair accessory kit according to claim 7, wherein said storage board perimeter is provided with a decorative trimming.

10. The decorative hair accessory kit according to claim 7, further comprising a lidded storage box for said kit.

* * * * *